US008661982B2

(12) United States Patent
Rohr

(10) Patent No.: US 8,661,982 B2
(45) **Date of Patent: *Mar. 4, 2014**

(54) ADAPTABLE SMART WARHEAD AND METHOD FOR USE

(75) Inventor: Paul R. Rohr, Clifton, VA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 167 days.

This patent is subject to a terminal disclaimer.

(21) Appl. No.: 13/474,976

(22) Filed: May 18, 2012

(65) Prior Publication Data

US 2012/0312184 A1 Dec. 13, 2012

Related U.S. Application Data

(62) Division of application No. 13/005,043, filed on Jan. 12, 2011, now Pat. No. 8,365,671, which is a division of application No. 11/581,729, filed on Oct. 16, 2006, now Pat. No. 7,891,297.

(60) Provisional application No. 60/727,141, filed on Oct. 14, 2005.

(51) Int. Cl.

| | |
|---|---|
| ***F42B 12/22*** | (2006.01) |
| ***F42B 12/44*** | (2006.01) |
| ***F42C 9/14*** | (2006.01) |
| ***F42C 11/00*** | (2006.01) |

(52) U.S. Cl.

USPC ..... 102/499; 102/491; 102/215; 102/265

(58) Field of Classification Search

USPC ..... 102/206, 215, 217, 499, 492, 473, 475, 102/491, 493, 494, 495, 265, 270

See application file for complete search history.

(56) References Cited

U.S. PATENT DOCUMENTS

| | | | | |
|---|---|---|---|---|
| 3,703,865 | A | 11/1972 | Gilbertson et al. | |
| 3,714,897 | A * | 2/1973 | Parker | 102/475 |
| 3,853,059 | A | 12/1974 | Moe | |
| 3,980,019 | A | 9/1976 | Anderson et al. | |
| 4,145,972 | A | 3/1979 | Menz et al. | |
| 4,282,814 | A | 8/1981 | Menz et al. | |
| 4,516,501 | A | 5/1985 | Held et al. | |
| 4,648,323 | A | 3/1987 | Lawther | |
| 4,658,727 | A | 4/1987 | Wilhelm et al. | |
| 4,823,701 | A | 4/1989 | Wilhelm | |
| 5,050,503 | A * | 9/1991 | Menz et al. | 102/475 |
| 5,182,418 | A | 1/1993 | Talley | |
| 5,212,343 | A * | 5/1993 | Brupbacher et al. | 102/323 |
| 5,229,542 | A | 7/1993 | Bryan et al. | |
| 5,415,103 | A | 5/1995 | Radermacher | |
| 5,544,589 | A * | 8/1996 | Held | 102/492 |
| 5,817,970 | A * | 10/1998 | Feierlein | 102/502 |
| 5,939,663 | A * | 8/1999 | Walters et al. | 102/476 |
| 5,996,501 | A * | 12/1999 | Spencer et al. | 102/286 |
| 6,135,028 | A | 10/2000 | Kuhns et al. | |
| 6,352,029 | B1 | 3/2002 | Guirguis et al. | |

(Continued)

*Primary Examiner* — James Bergin

(74) *Attorney, Agent, or Firm* — Daniel J. Long

(57) ABSTRACT

A method for detonating a munition comprising the steps of providing a plurality of micro-detonators and microprocessors in said munition and initiating said micro-detonators in a predetermined sequence by means of said microprocessor. Depending on the specific predetermined sequence which is selected, one of a variety of explosive modes may be achieved.

6 Claims, 3 Drawing Sheets

(56) References Cited

U.S. PATENT DOCUMENTS

| | | | | |
|---|---|---|---|---|
| 6,363,853 | B1 | 4/2002 | Rohr | |
| 7,347,906 | B1 | 3/2008 | Guirguis | |
| 7,717,042 | B2 * | 5/2010 | Lloyd | 102/497 |
| 7,891,297 | B1 | 2/2011 | Rohr | |
| 8,365,671 | B2 * | 2/2013 | Rohr | 102/499 |

* cited by examiner

ADAPTABLE SMART WARHEAD AND METHOD FOR USE

CROSS REFERENCE TO RELATED APPLICATION

This application is a division of U.S. application Ser. No. 13/005,043, filed Jan. 12, 2011 which is a division of U.S. application Ser. No. 11/581,729, filed Oct. 16, 2006, now U.S. Pat. No. 7,891,297 B1 which claimed rights under 35 U.S.C. §119(e) from U.S. Application Ser. No. 60/727,141, filed Oct. 14, 2005, the contents all of which are incorporated herein by reference.

BACKGROUND OF THE INVENTION

1. Field of the Invention

The present invention relates to munitions and, more particularly, to methods and apparatus for increasing the lethality of existing warheads against an array of different targets.

2. Brief Description of Prior Developments

In the use of munitions, different types of warheads are conventionally often used to attack different types of targets. This practice may impose significant logistical challenges for maintaining combat forces in the field and may increase the complexity of carrying out combat operations.

A need, therefore, exists in an improved method and apparatus for making munitions more adaptable so that they may be employed against a wide variety of targets.

There is a further need for a warhead whose output can be tailored in response to intelligence input information.

There is a further need for a warhead having an ability to reconfigure its output using an imbedded microprocessor.

There is still a further need for a warhead which produces special outputs that are both tailored to the vulnerabilities of the target being attacked and directed toward the target to dramatically increase the warhead effects on that target.

SUMMARY OF INVENTION

The present invention is a method and apparatus for initiating the high explosive in a warhead differently, the blast and fragment output of the warhead can be shaped and directed toward the target of interest. By utilizing micro-detonators and initiating them in a predetermined sequence by an on-board microprocessor, many different explosive modes can be created by the same warhead. Furthermore, the mode selection process can be integrated with other electronic targeting systems such as Automatic Target Recognition (ATR) and various smart fuse designs to produce a fully programmable weapon system.

BRIEF DESCRIPTION OF THE DRAWINGS

The present invention is further described with reference to the accompanying drawings wherein.

DETAILED DESCRIPTION OF THE PREFERRED EMBODIMENT

Figure 1:
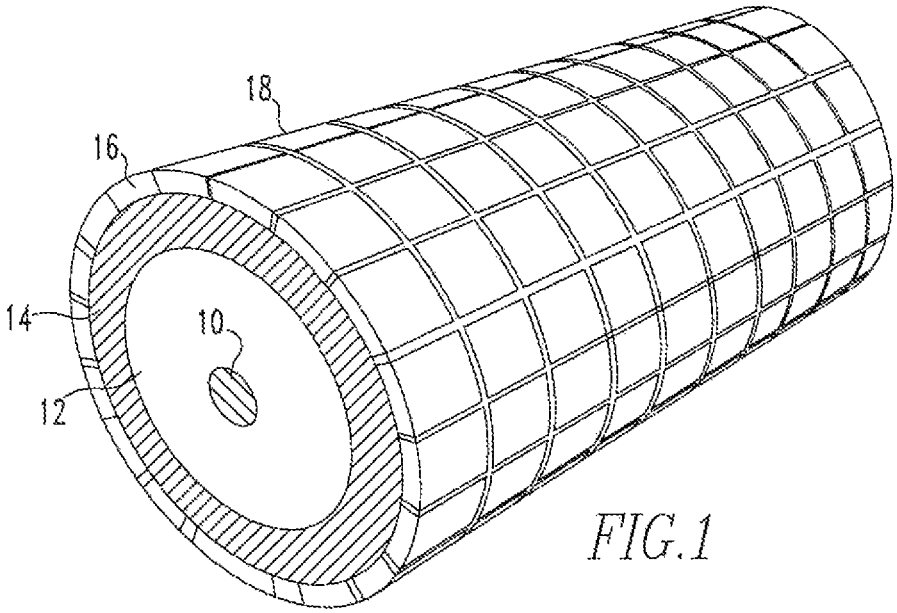
FIG. 1 is a perspective view of a preferred embodiment of the munition of the present invention.

The use of an energetic material having a controllable rate of magnitude of energy release has broad application to a number of military applications. For example, the warhead of the present application may be applied to energetic systems for mine clearing, rock penetration, and wall breaching. The warhead of the present invention is believed to control the processes of deflagration, transition, and detonation and in condensed phase explosives through the use of a smart igniter coupled with functionally graded energetic materials and specially designed charge geometries. This invention not only allows several orders of magnitude of variation in energy release rate of the warhead to be achieved, but also allows a range of effects to be produced which include enhanced blast, improved shrapnel acceleration, and a dud or incendiary, e.g. case burning mode for safe destruction or fire initiation, as well as energy focusing on the target.

The ability to fabricate charges which may deflagrate, operate entirely in transition between deflagration and detonation, or be overdriven to strong detonation is possible by a proliferation of low energy detonators distributed throughout the change, initiated in response to a microprocessor. The microprocessor is given input from any number of information systems, to include pre-launch/deployment data or on-board, real-time sensor systems and may be programmable during or immediately prior to delivery. The result is a single weapon with multi-mission functionality.

The quasi-steady deflagration and detonation process in condensed systems is a research problem that has been studied since the end of the nineteenth century. The problem is far from being completely understood, but several advances on multiple fronts, including improved understanding, dramatic reductions circuit size and energy requirements, and improved three dimensional simulation capabilities, will now allow control of this process.

Transition from deflagration to detonation is a multistage process. The idea underlying recent research interests has been to separate and study each phase of the process, i.e. deflagration and detonation. This approach has been most revealing, since in some cases, e.g. intense impact, shock, high impulse of a detonation the individual stages last a very short time and some may even appear to be absent. More recent research has lead to an increased understanding of the transition phase that separates the deflagration and detonation processes, and specifically to the development of techniques for sustaining the transition phases for extended periods. This can be accomplished by a knowledgeable choice of energetic material, grain size, surface coating, charge geometry, and most importantly-ignition parameters.

This method and apparatus of the present invention allows for an adaptive explosive composition charge which will accomplish the necessary control by employing a multiple controllable low energy detonators, functionally graded energy density explosives, and novel charge geometries to control the warhead energy release rate. These controls will be utilized to operate the charge in a deflagration, convective burning, or detonation mode and thereby vary the energy release rate. A cylindrical warhead design of this type would preferably consist of an inner cylinder of fully dense explosive surrounded by an outer annulus of porous propellant, a sheet of electrical igniters, and a case, which may break up into shrapnel.

Referring to FIG. 1, there is a central full defragration igniter 10. Peripherally surrounding and positioned radially outwardly form the central defragration igniter 10, there is a full-density explosive core 12. Peripherally surrounding and positioned radially outwardly from the full-density explosive core 12, there is a porous convective burning layer 14. Peripherally surrounding and positioned radially outwardly from the porous convective burning layer 14 there is a peripheral sheet igniter 16. Peripherally surrounding and positioned radially outwardly from the peripheral sheet igniter 16 there is a profragmenting pressure case 18.

Those skilled in the are will appreciate that the munition of the present invention may be in any of the five following modes:

1. Blast and Shrapnel: The charge may be overdriven by a simultaneous initiation of the igniters, all the energetic material (EM) goes to detonation, maximum blast effect is achieved, and the case shatters and produces very small, high velocity shrapnel.
2. Fragment Acceleration: The composite charge may be driven to convective burning by a simultaneous initiation of only a few on-axis detonators. This low-rate, high-pressure rise allows the case to break along grooves designed to selectively weaken it and control fragment size. Simultaneous with this event, the inner cylinder with full density explosive is initiated and efficiently accelerates the fragments.
3. One of four off-center line of initiators may be used to cause a radially directed cylindrical blast to propel shrapnel toward the target as the warhead flies by.
4. A forward directed blast configuration may be achieved by using an inward directed cylindrical charge to confine a fast running axial directed main charge thus producing a very long duration blast at the front of the warhead.
5. Dud or Incendiary: In the event that the warhead needs to be duded, one small end igniter coupled may be used with a pyrotechnic blowout plug to produce a safe deflagration of all the chemical energy present. If the case is composed of a high density, reactive metal pair, an incendiary reaction will ensue.

Figure 2:
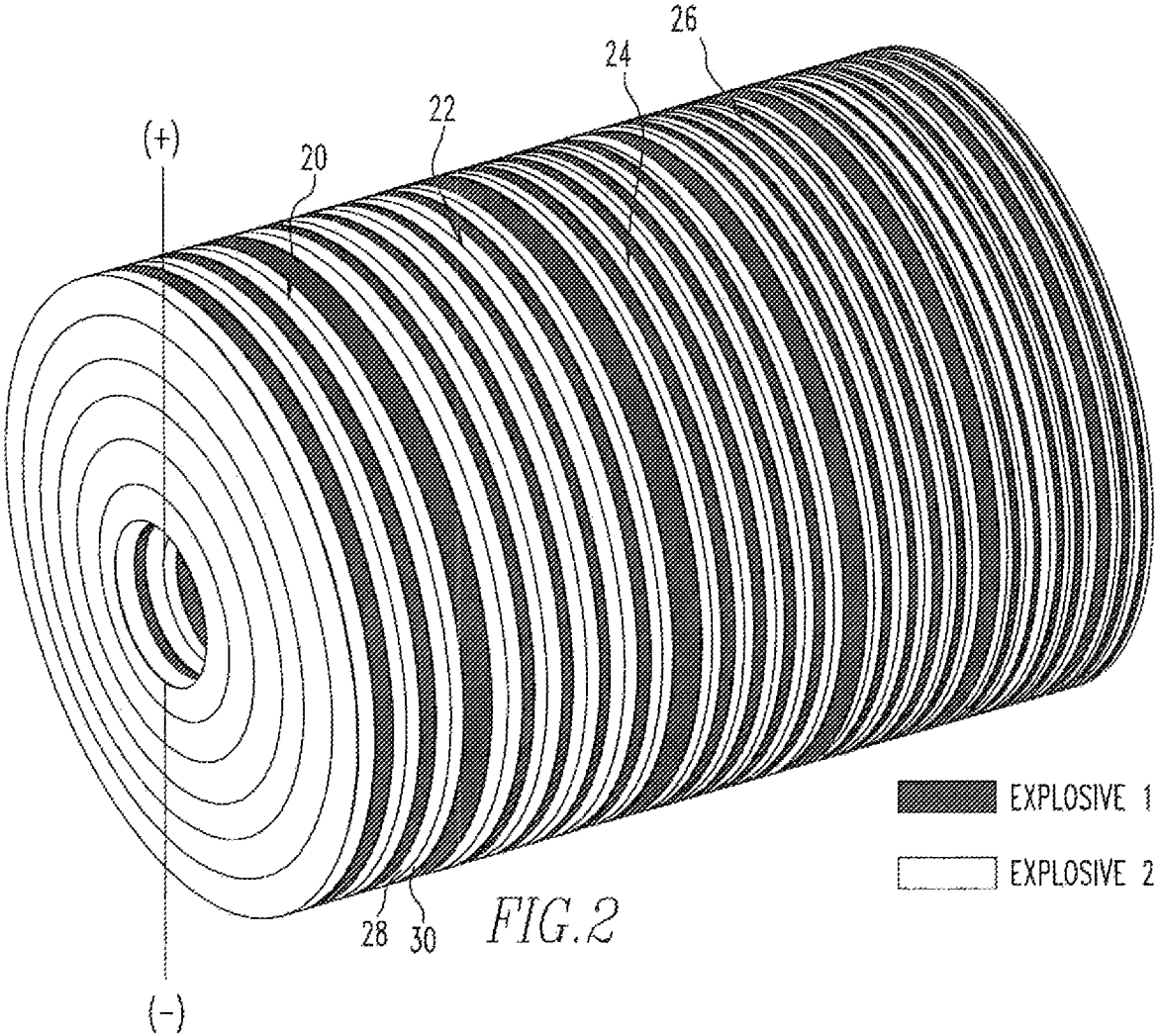
FIG. 2 is a drawing showing a perspective view of a preferred embodiment of the smart charge used in the munition of the present invention fully populated with micro detonators.

If the spatial and temporal structure of explosive energy release can be controlled within a warhead, concepts such as confining the energy release in one primary direction or projecting fragment release toward the target and other energy release mechanisms are possible. FIG. 2 shows an example of a fully versatile charge design although in alternate embodiments actual warheads with only a few well defined modes of operation might appear to be simpler.

Referring to FIG. 2, the charge is assembled from alternate layers of micro-detonator sheets as at 20, 22, 24 and 26, and layers of a first explosive as at explosive 28 and a second explosive as at explosive 30, where the first and second explosives have differing energy release rates. In this example, varying the timing of electrical impulses between sheets can cause the plane detonation wave to travel in either directions, multiple waves can be generated, or the appearance of a bulk initiation of the entire charge. For example, sheets 20 and 22 may be timed at $t=0$, while sheets 24 and 26 may be timed at $t=t_1>0$. With additional explosively generated circumferential and end confinement, the warhead could be made to burst from one end, focusing its energy there instead of dispersing the energy over $4\pi$ radians as in conventional warheads.

Figure 3:
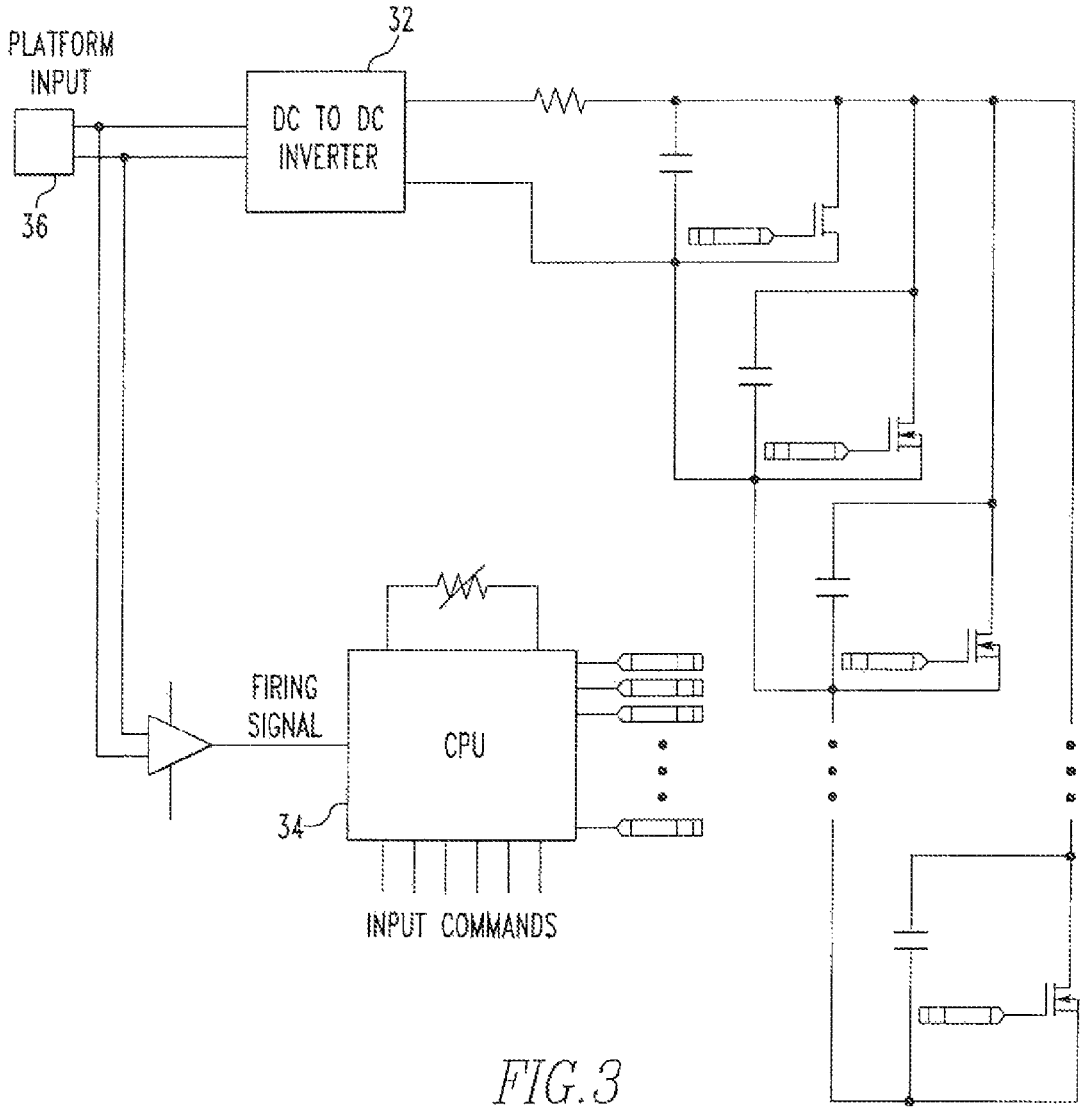
FIG. 3 is a schematic drawing showing a preferred embodiment of the smart charge trigger command, control circuitry, and power supply.

Shaping and directing energy release may be accomplished by microprocessor control. As such, a wide variety of configurations are possible, limited only by the size of the memory and the existence of the necessary micro-detonators, An example of a proposed control circuit is shown in FIG. 3. In FIG. 3 the firing circuit includes a DC to CD converter 32 and CPU 34 that are coupled to the platform input 36. The ignition process begins with the charging of firing capacitors (C1, C2, C3 . . . Cn), sized from 0.1 to 10 μf, that are coupled to the DC to DC inverter 32. The firing capacitors are then selectively switched across resistive loads (RL1, RL2, RL3 . . . R1*n*), namely the series circuits containing the igniter pads, by a semiconductor switching such as a SCR, FET, or gate controlled switch (in the illustrated example Q1, Q2, Q3 . . . Qn) under control of the CPU 34 which can be programmed to provide any desired firing sequence or timing.

The circuit can be energized by an internal battery or in this case by the weapon platform itself. Energizing the power supply allows the microprocessor to receive commands from the platform's central fire control computer. A firing power supply which stores energy to drive the detonators is also energized. The firing command can come over the same two conductors as the power in the form of a pulse coded signal from on-board fusing sensors coupled with an Automatic Target Recognition (ATR) system which take full advantage of the warhead's mode selection ability. Each detonator circuit (which may contain many detonators) is switched by a separate semiconductor, time precisely by the microprocessor, and supplied from a single energy storage capacitor. The entire circuit is easily miniaturized and shock hardened for stressing applications such as gun projectile warheads.

Further information which may be useful to those skilled in the art concerning preferred methods and apparatus for practicing the method and apparatus of this invention may be disclosed in U.S. Pat. No. 6,363,853, the contents of which are incorporated herein by reference.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method for detonating a munition comprising the steps of providing a central igniter being positioned axially; providing an explosive core, said explosive core positioned radially outwardly from the central igniter and surrounding said central igniter and wherein the explosive core comprises a first explosive and a second explosive, said first explosive and said second explosive having differing energy release rates; providing at least one microprocessor and a plurality of micro-detonators; providing a munition casing or housing enclosing said central igniter, said explosive core, said at least one microprocessor and said plurality of detonators; and said at least one microprocessor initiating said micro-detonators in a variety of explosive modes.

2. The method of claim 1 wherein said central igniter is a full deflagration igniter.

3. The method of claim 1 wherein explosive core is a full-density explosive core.

4. The method of claim 1 further comprising a convective burning layer, said convective burning layer peripherally surrounding said explosive core.

5. The method of claim 4 further comprising a sheet igniter, said sheet igniter peripherally surrounding said convective burning layer.

6. The method of claim 5 further comprising a profragmenting pressure case, said profragmenting case peripherally surrounding said sheet igniter.

* * * * *